United States Patent [19]

Reman

[11] Patent Number: 4,579,347

[45] Date of Patent: Apr. 1, 1986

[54] ALIGNMENT TYPE GAME WITH ALIGNMENT INHIBITING MEANS

[76] Inventor: Wilhelm Reman, 1905 NW. 29th, Apartment 211, Portland, Oreg. 97210

[21] Appl. No.: 680,418

[22] Filed: Dec. 11, 1984

[51] Int. Cl.[4] ..... A63F 3/00

[52] U.S. Cl. ..... 273/264

[58] Field of Search ..... 273/264, 263, 242, 267, 273/275, 271, 236; D21/34

[56] References Cited

U.S. PATENT DOCUMENTS

| | | |
|---|---|---|
| 1,714,792 | 5/1929 | Kurihara . |
| 4,196,905 | 4/1980 | Yanari . |
| 4,371,170 | 2/1983 | Acevedo . |
| 4,448,422 | 5/1984 | Rose . |

FOREIGN PATENT DOCUMENTS

| | | | |
|---|---|---|---|
| 266855 | 4/1913 | Fed. Rep. of Germany | 273/242 |
| 795701 | 1/1936 | France | 273/271 |
| 52576 | 1/1911 | Switzerland | 273/242 |

*Primary Examiner*—Richard C. Pinkham
*Assistant Examiner*—Matthew L. Schneider
*Attorney, Agent, or Firm*—Henderson & Sturm

[57] ABSTRACT

A game board apparatus (10) comprising a plurality of playing pieces (12), and a game board (11); wherein the game board has a number x of diminishing diameter geometrical configurations (14) in the form of squares (15) formed from and attached to one another by solid (17) and broken (16) lines that delineate the movement of the playing pieces (12) on the game board (11).

4 Claims, 1 Drawing Figure

ALIGNMENT TYPE GAME WITH ALIGNMENT INHIBITING MEANS

TECHNICAL FIELDS

This invention relates generally to game board apparatus.

BACKGROUND OF THE INVENTION

The prior are is replete with various game board apparatus and playing pieces as is evidenced by U.S. Pat. Nos. 4,448,422; 4,371,170; 4,196,905; and 1,714,792.

Virtually all of the prior art games have as their object the movement of game pieces along the game board, in accordance with the patterns of the board, and the rules that govern the movement of the game pieces.

While most prior art game apparatus employ various degrees of luck, skill and strategy; it seems that a common theme runs through the oldest, most well recognized, and most often played games, such as checkers, chess, etc. That theme or principle concerns the fact that the players involved in the game determine the movement of the game pieces in response to the relative position not only of their own pieces, but also the relative position of their opponent's pieces.

Despite the fact that the above stated principle has been well recognized virtually for centuries; there has not been developed in recent memory, a game board apparatus that even remotely approached the popularity of the aforementioned "classic" game boards. With this fact in mind the game board that forms the basis of the present invention was developed.

BRIEF SUMMARY OF THE INVENTION

The name given to the present game board apparatus is "MOZOG". The game board apparatus comprises a game board, and a plurality of game pieces. The object of the game being for one of the players to capture a given number of the other player's game pieces.

The game board itself has a series of diminishing squares imprinted thereon, wherein at least some of the squares have sides formed by broken lines, and at least two corners on adjacent squares are connected by broken lines. In addition, dots are formed on the corners and intermediate the ends of each square, and the intermediate dots along each side are connected by broken of solid lines.

The game pieces are in the form of tokens or the like, and each plauer is given an equal number of tokens; wherein the tokens of one player have a color different than the tokens of the other player; and, the combined number of tokens is substantially less than the total number of dots formed of the playing board.

According to the rules that govern the playing of the game, the players alternate placing their tokens upon the selected dots, and they are allowed to remove one of their opponent's tokens, each time they achieve a certain alignment of a given number of tokens on adjoining dots. The game continues with alternate movement of the tokens until one of the players has been reduced to playing with a limited number of tokens.

BRIEF DESCRIPTION OF THE DRAWINGS

These and other objects, advantages, and novel features of the invention will become apparent from the detailed description of the best mode for carrying out the invention which follows; particularly when considered in conjunction with the accompanying drawing, wherein.

BEST MODE FOR CARRYING OUT THE INVENTION

Figure 1:
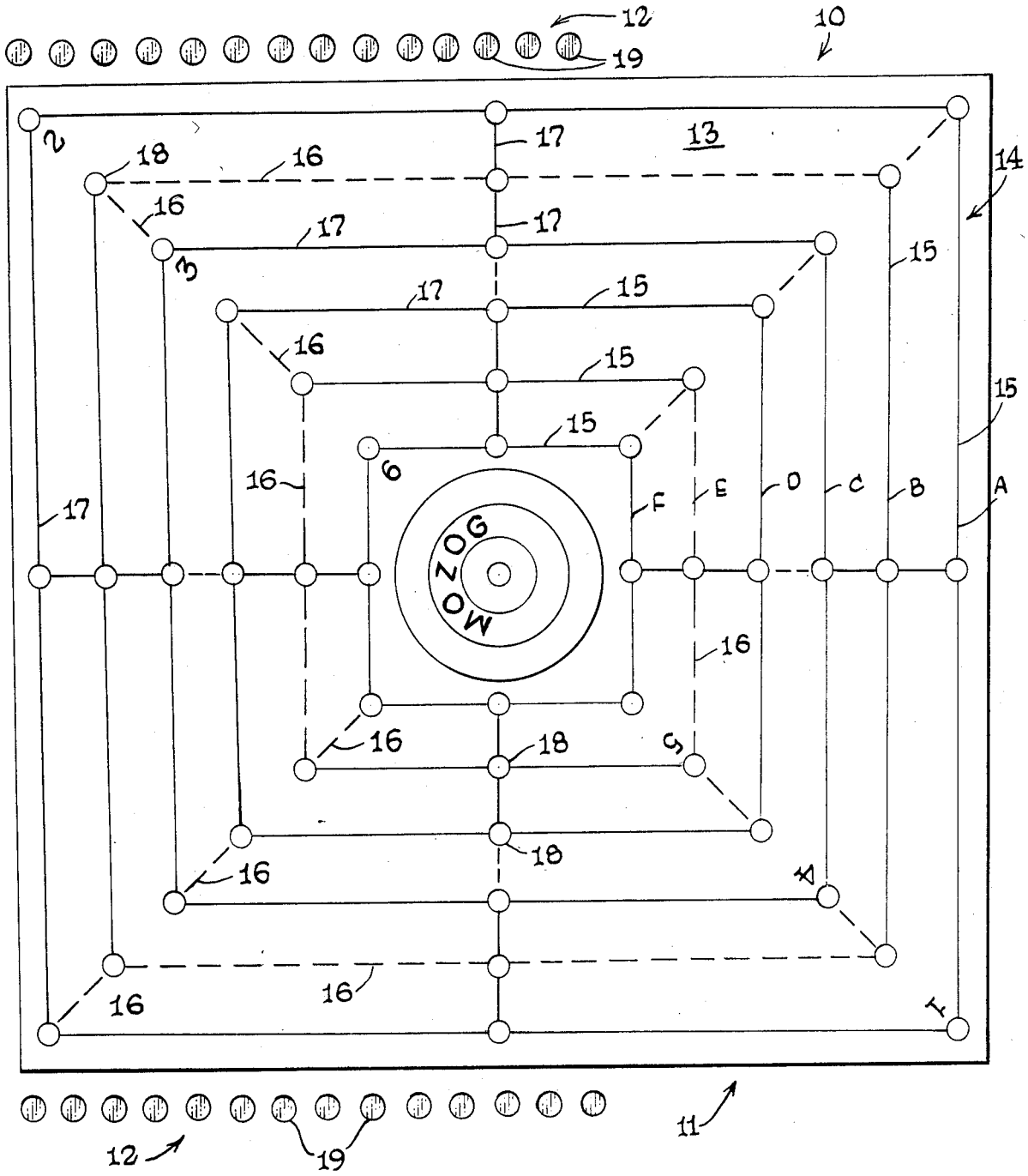
FIG. 1 is a top elevation view of the game board apparatus.

As can be seen by reference to FIG. 1, the game board apparatus that forms the basis of the present invention is designated generally by the numeral (10). the apparatus (10) comprises in general a game board (11) and playing pieces (12).

The game board (11) comprises a generally flat rectangular board (13) having a number "x" of diminishing diameter geometrical configurations (13) imprinted thereon. As shown in the drawing, in the preferred embodiment of this invention, the geometrical configuration (14), comprises a plurality of squares (15) whose dimensions decrease towards the center of the game board (11).

In the preferred embodiment of this invention depicted the plurality of squares (15) numbers six, and each of the six squares are connected to adjacent squares by broken lines (16).

For the purpose of describing and defining the pattern imprinted on the game board each of the six squares (15) will be given a letter designation, with the outermost square being labeled "A:, and the innermost square being labeled "F". With this in mind, it can be seen that squares A,C,D and F are delineated by solid lines (17) and squares B and E are delineated by opposed pairs of solid lines (17) and broken lines (16). It can also be seen from the drawings that each of the squares is provided with dors (18) at their corners, and at the midpoint of each of their sides.

As shown in FIG. 1, and described above each of the squares (15) is connected to adjacent squares (15) by opposed pairs of broken lines (16), which extend from alternating corners of the adjacent squares. In addition the sides of the squares are connected by solid (17) and broken (16) lines which extend from the dots (18) at the midpoint of each side of the respective squares. The sides of squares A through C and D through F are connected by solid lines (17) and the sides of squares C and D are connected by broken lines. It should also be noted that opposing corners of squares A and C are provided with the "1", "2" and "3,4" respectively, while a corner of squares E and F are provides with the numbers "5" and "6" respectively.

The playing pieces (12) comprise a plurality of tokens (19) of the like wherein each player receives a given number "y" of tokens (19) of a color different from the color of their opponent's tokens. It should also be appreciated that the number "z" of dots (18) of the game board, wherein $z=x+8$ is substantially greater than the combined number of tokens $(y+y)$.

As shown in the drawing in the preferred embodiment of the invention, the number x of squares is six, and the number y of tokens for each player is fourteen, and with that in mind, the procedure for playing the game progresses as follows:

Object of the Game: To score a point a player must align three tokens in a straight line on adjoining dots connected by a solid line. Each time one player scores a point, that player takes one of the other player's tokens off the board. When one player has scored 12 points, that player wins the game because the other player can no longer score a point.

Scoring points: A player scores a point by aligning three tokens in a straight line on adjoining dots connected by a solid lien. This may occur at any time after the players have placed tokens on the six numbered dots on the board.

When a player scores a point, that player selects one of the other player's tokens and removes it from the board.

A player can score a point only twice in the same game with the same alignment.

Start of play: Phase I: Each player receives 14 tokens of one color. The player with the white tokens starts play by placing their tokens on the board until all six of the numbered dots have tokens on them.

The players take turns placing their tokens on any dot on the board. The players then alternate placing their remaining tokens on the board until all 14 of each player's tokens are on the board.

Continuation of Play: Phase II: When one player has only three tokens remaining on the board, the player may move one token to any unoccupied dot on the board on that player's next turn, and on each turn thereafter until the game ends.

If the other player has more than three tokens remaining the other player must continue to move tokens only to adjoining dots.

Continuation of play: Phase IV: If both players have only three tokens remaining on the board, both players may move tokens only to an adjoining dot on the board until the game ends.

Winning the game: A player wins the game by scoring twelve points, thereby removing all but two of the other player's tokens from the board.

Having thereby describrd the subject matter of this invention, it should be appreciated that many substitutions, modifications and variations of the invention are possible in light of the above teachings. The most obvious modifications being the number y of each player's tokens. It is therefore to be understood that the invention as taught and described herein is only to be limited to the extent of the breadth and scope of the appended claims.

What I claim is:

1. A game board apparatus consisting of:

a plurality of playing pieces; and a game board having a number "x" of equally spaced diminishing squares imprinted thereon, wherein adjacent squares are connected to one another by broken lines extending from opposed alternating corners of the respective squares, wherein each of the corners and mid-point of the sides of each of the squares are provided with dots, wherein at least one of the squares is delineated by solid lines and another of the squares is delineated by opposed pairs of solid and broken lines, and wherein at least two adjacent sides of adjacent squares are connected by solid lines, at least two adjacent sides of adjacent squares are connected by broken lines and wherein all adjacent sides of adjacent squares are connected by lines.

2. An apparatus as in claim 1 wherein the game board has numerals imprinted thereon.

3. An apparatus as in claim 1; wherein the playing pieces comprise:

a number "y" of tokens of one color, and a number "y" of tokens of another color.

4. An apparatus as in claim 3; wherein, the total number "z" of dots imprinted on the board equals "x"$\times$8, and the number "z" is substantially larger than the combined number of tokens which is the sum of "y" plus "y".

* * * * *